US008069503B2

(12) United States Patent
Lo

(10) Patent No.: US 8,069,503 B2
(45) Date of Patent: Dec. 6, 2011

(54) WATER REFILLING DEVICE FOR WATER SAVING TOILETS

(75) Inventor: Tsung-Yi Lo, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 449 days.

(21) Appl. No.: 12/468,239

(22) Filed: May 19, 2009

(65) Prior Publication Data

US 2010/0293706 A1 Nov. 25, 2010

(51) Int. Cl.
*E03D 1/00* (2006.01)

(52) U.S. Cl. ..... 4/415; 4/324

(58) Field of Classification Search ..... 4/324, 345, 4/415

See application file for complete search history.

(56) References Cited

U.S. PATENT DOCUMENTS 4,497,076 A * 2/1985 Sullivan ..... 4/392
5,594,959 A * 1/1997 Nichols-Roy et al. ..... 4/415
5,862,538 A * 1/1999 Ho ..... 4/366
6,385,788 B1 * 5/2002 Wasielewski ..... 4/415
6,823,889 B1 * 11/2004 Schuster ..... 137/441
6,962,163 B1 * 11/2005 Edwards ..... 137/1
7,743,436 B1 * 6/2010 Schuster et al. ..... 4/415
2009/0019627 A1 * 1/2009 Le et al. ..... 4/415

* cited by examiner

*Primary Examiner* — Gregory Huson
*Assistant Examiner* — Janie Christiansen

(57) ABSTRACT

A quantitative refill device is mounted on the top end of an overflow pipe in a water tank of a water saving toilet and comprises a first pipe, a second pipe and a float device. The second pipe defines a second chamber. Initially, water flows to the overflow pipe to create a water closing through a water flow passage between the second pipe and the float pipe, especially a conical passage defined between a conical surface of the second pipe and a conical portion of the float device. Meanwhile, the float device moves upward along with the rise of the water level of the second chamber to close the conical passage. By the time the conical passage is closed, the water closing is formed, and the refilled surplus water will overflow into the water tank, thus creating a quantitative water refilling effect.

14 Claims, 14 Drawing Sheets

WATER REFILLING DEVICE FOR WATER SAVING TOILETS

BACKGROUND OF THE INVENTION

1. Field of the Invention

The present invention relates to a water refilling device for water saving toilets.

2. Description of the Prior Art

For the Liter Per Flush (LPF) of the existing water saving toilet with small/big flush buttons, the proportion between the big flush and small flush is about 6/3 LPF to 6/4 LPF, and during the whole water refill process, water flows through the overflow pipe of the discharge valve of the water tank into the toilet bowl, creating a water closing. When the big flush is activated, the water of the water tank goes down to a level lower than the water level when the small flush button is pushed, hence, it takes a relatively longer time for the water to return to the normal level, namely, the water refilling time is relatively long. If it takes a refilling time T1 to form the water closing after the small flush, the water refilling time for the big flush T2 will be too long and cause excessive refilling, that is to say that the water refilled during the time of T2–T1 is useless and will flow to the waste pipe. Statistic and experiments show that the average amount of water loss is as much as 1.0 to 1.6 L.

The amount of water loss must be reckoned in the total water consumption of the toilet, so some methods are to adjust the water consumption of the big flush of the toilet down by 1.0 to 1.6 L, so that the real water amount of the big flush is less than 5 LPF, and as a result, the performance of the big flush is considerably decreased.

The present invention has arisen to mitigate and/or obviate the afore-described disadvantages.

SUMMARY OF THE INVENTION

The primary object of the present invention is to provide a water refilling device for water saving toilets which is capable of overcoming the shortcomings of the conventional toilet.

A quantitative refill for a double function water saving toilet in accordance with the present invention is disposed in a water tank, inside the water tank are disposed an inlet valve, a double function flush valve, an overflow pipe connected to the flush valve, and a refill pipe connected to the inlet valve, the quantitative refill device comprising:

a first pipe with a lower end fixed to a top end of the overflow pipe defining a first chamber and an outlet which is in communication with a lower end of the first chamber and the overflow pipe;

a second pipe fixed in the first chamber of the first pipe, an outer surface of the second pipe and an inner surface of the first chamber defining a water flow passage therebetween, a top end of the water flow passage defining an overflow inlet for allowing water in the water tank to overflow, a lower end of the water flow passage being connected to the outlet of the first pipe, the second pipe being defined with a second chamber into which the water is refilled from the refill pipe, a lower edge of the second pipe tapering upwards to form a conical surface, and then the conical surface extending upwards to form a through hole in communication with the second chamber;

a float device comprising a float body, a rod portion extending downwards from a bottom of the float body, and a sealing portion extending downwards from a bottom of the rod portion, the float body being received in the second chamber of the second pipe, the rod portion being inserted through the through hole of the second pipe in such a manner that an outer periphery of the rod portion and an inner surface of the through hole define a water flow passage therebetween, the sealing portion being defined with a conical surface shaped correspondingly to the conical surface of the second pipe, and in normal condition, the sealing portion, under the effect of the gravity of the float device, defines a conical passage with respect to the conical surface of the second pipe, the conical passage enables an outflow of water flowing therethrough to be controlled to be smaller than an inflow of water refilled into the second chamber from the refill pipe, at the beginning of the water refilling process, water flows to the second chamber and then to the water flow passage and the conical passage and finally into the overflow pipe, to provide enough water to form a water closing, after that, the float body will move upward along with a rise of a water level of the second chamber and drive the whole float device to move upward, making the conical surface press against the conical surface, so as to close the conical passage after the water has been refilled for a predetermined time, creating a quantitative water refilling effect, and surplus water will overflow into the water tank from a top end of the second chamber, when the conical passage is closed, the water in the second chamber can still be leaked into the overflow pipe by a leakage design.

The outflow rate and opening degree of the water of the conical passage are changeable by adjusting a distance between the float body and the sealing portion, so as to adjust the time for closing the conical passage after the water refilling operation is activated.

When the water refilling operation is activated, the conical passage can be closed automatically by buoyancy, creating a quantitative water refilling effect. Normally, the time can be set to be equal to the time required for creating the water closing, making the refilled water of the big flush be equal to that of the small flush, so as to reduce the water loss generated during the big flush.

When the water closing is formed, the refilled surplus water will be guided into the water tank, thus accelerating the upward movement of the water level of the water tank while reducing the water refilling time.

The water passages and the overflow inlets between the two pipes and the second chamber provide an overflow function. In case of a malfunction of the inlet valve, water can be guided into the overflow pipe by the water passages and the overflow inlets, preventing water overflowing the water tank.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
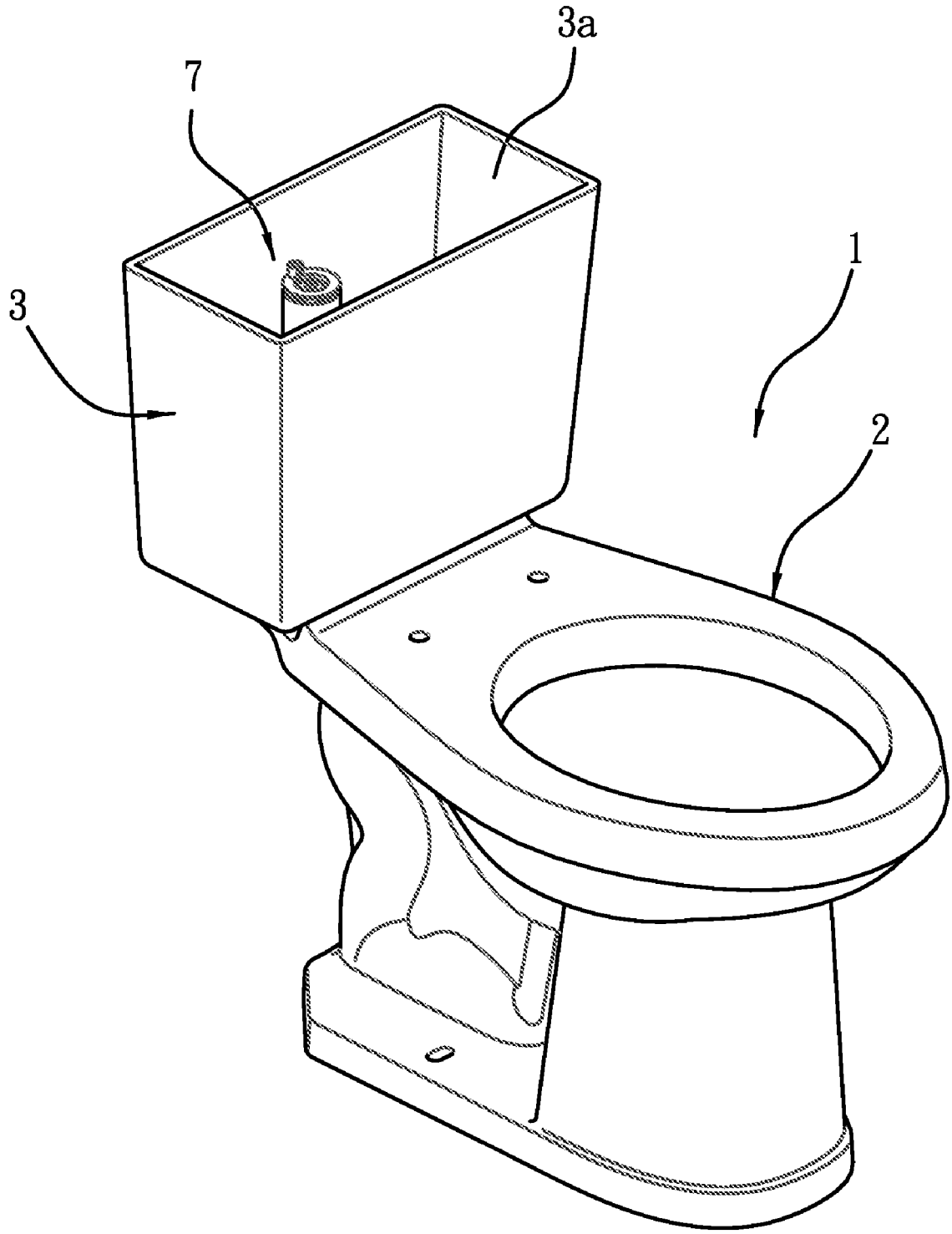
FIG. 1 is a perspective view of a water refilling device for water saving toilets in accordance with the present invention.
Figure 2:
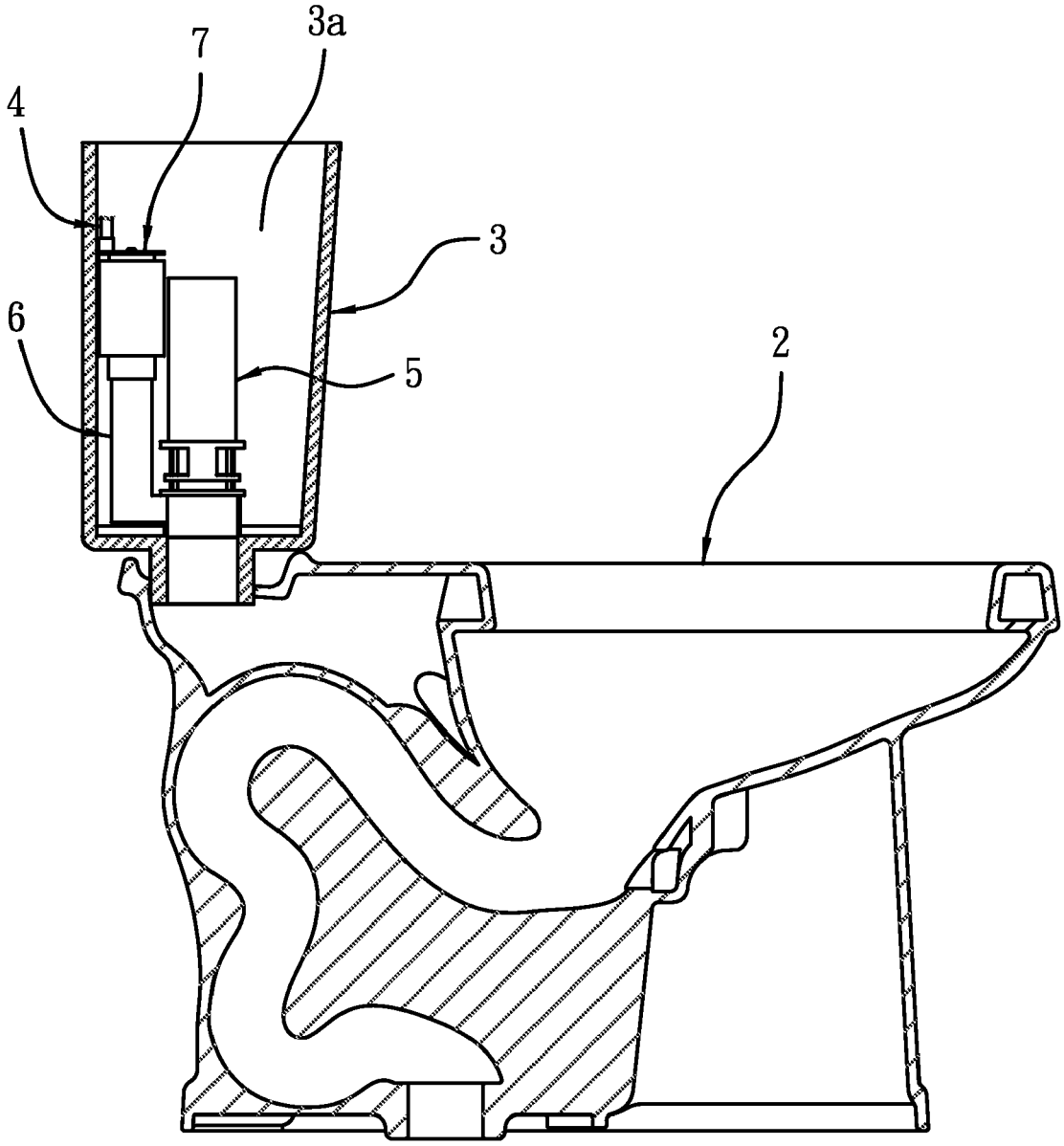
FIG. 2 is a cross sectional view of the water refilling device for water saving toilets in accordance with the present invention.
Figure 3:
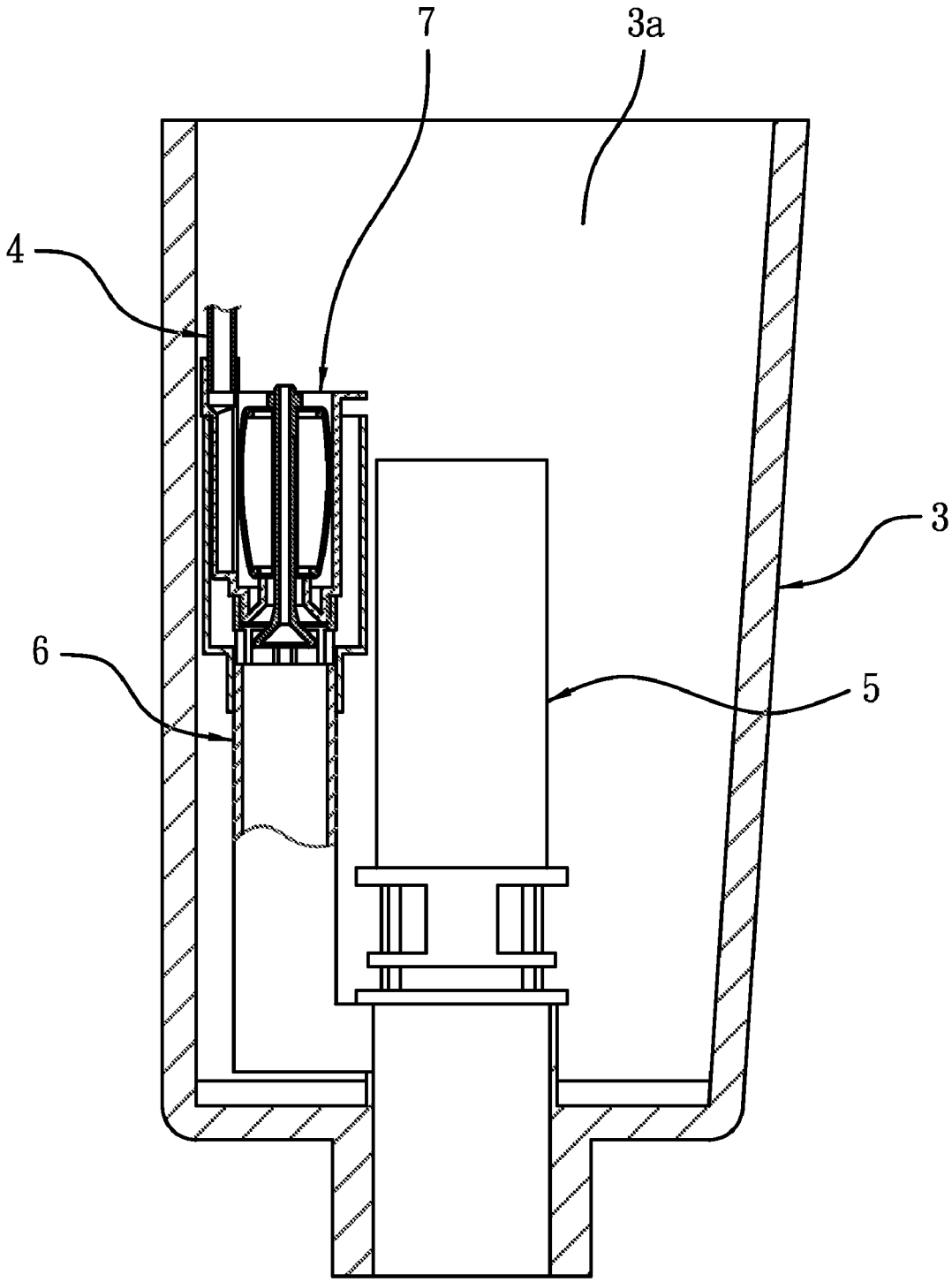
FIG. 3 is a cross sectional view in accordance with the present invention showing that the refill device is mounted on the top end of the overflow pipe inside the water tank.

Referring to FIGS. 1-3, a quantitative refill device 7 for a water saving toilet with small/big flush buttons is shown, wherein the water saving toilet 1 comprises a toilet bowl 2, a water tank 3 mounted at one side of the toilet bowl 2, an inlet valve (not shown) disposed in an inner space 3*a* of the water tank 3, a refill pipe 4 connected to the inlet valve, a double function flush valve 5 and an overflow pipe 6 connected to the flush valve 5. The quantitative refill device 7 can be mounted on the top end of the overflow pipe 6 and comprises a first pipe 10, a second pipe 20 and a float device 30.

Figure 4:
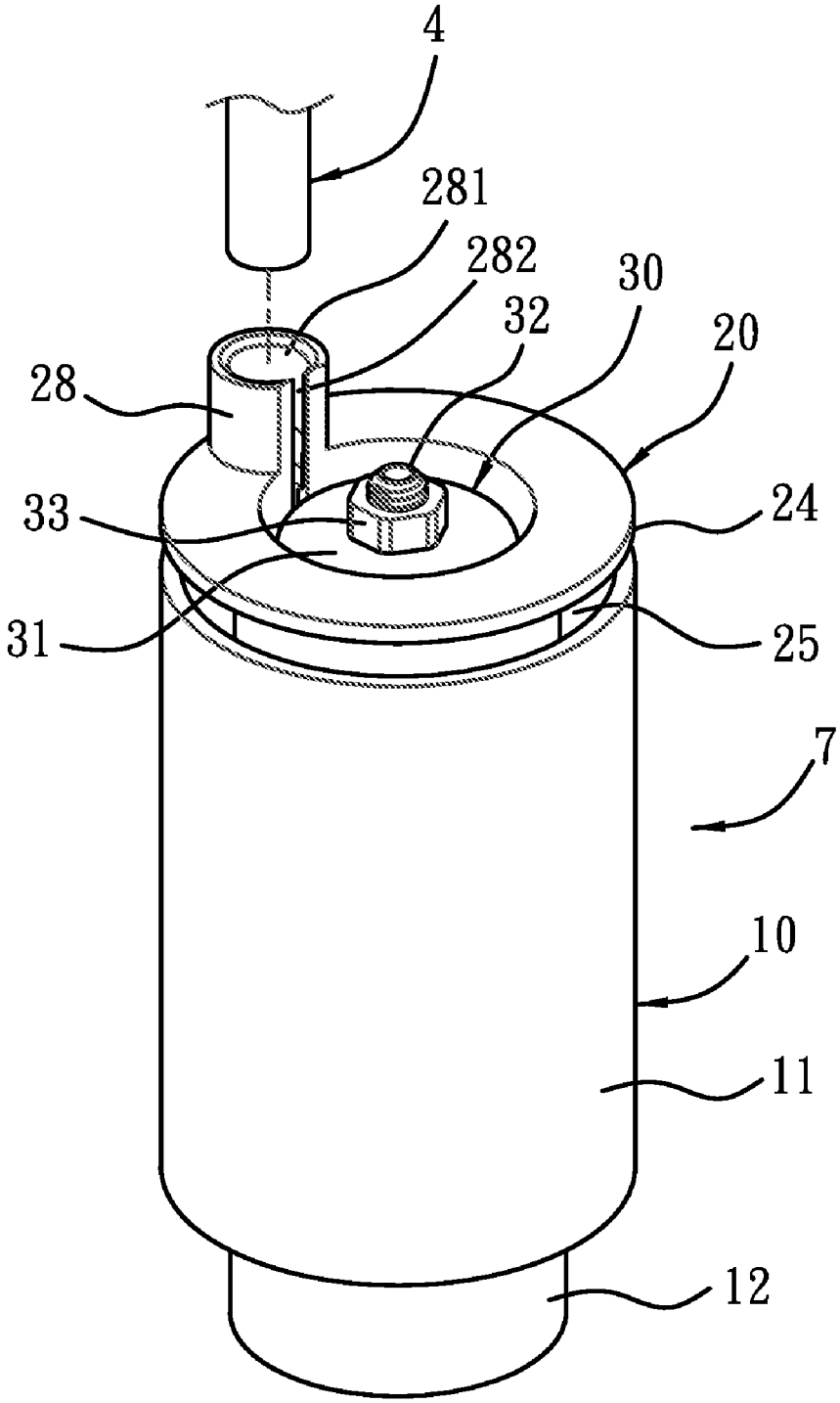
FIG. 4 is an assembly view showing that the water refilling device for water saving toilets in accordance with the present invention is provided with a refill pipe.
Figure 5:
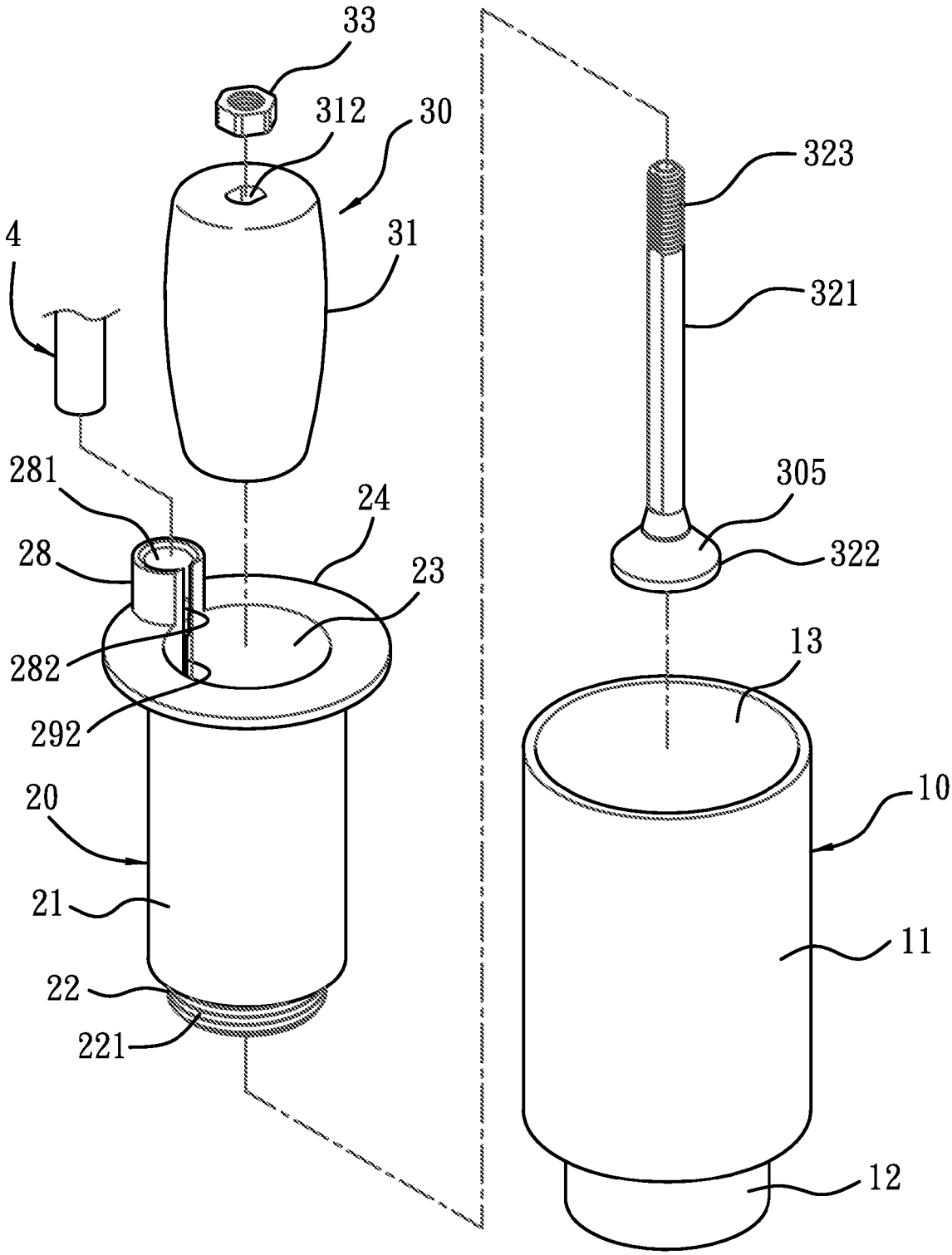
FIG. 5 is an exploded view showing that the water refilling device for water saving toilets in accordance with the present invention is provided with a refill pipe.
Figure 8:
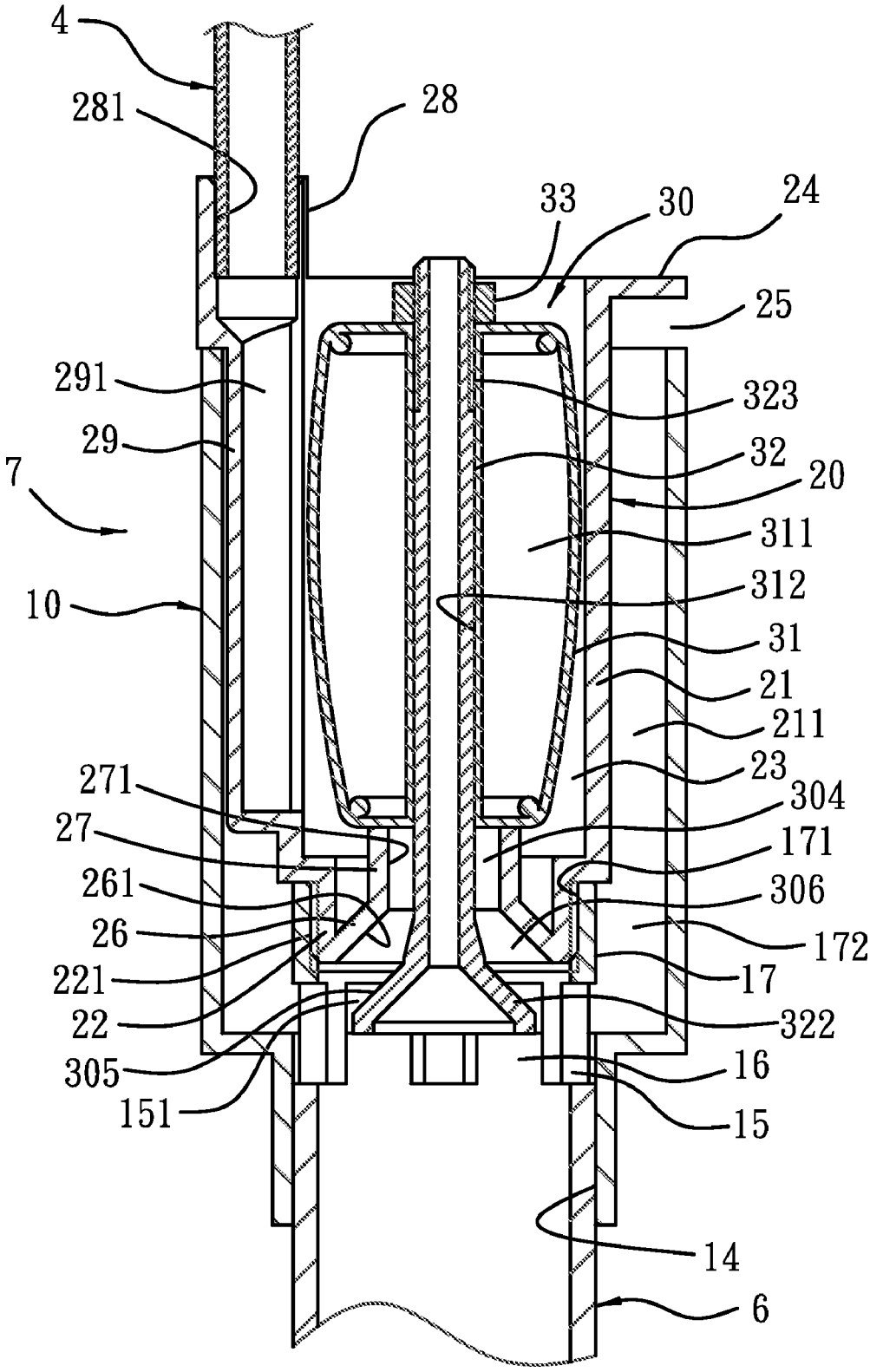
FIG. 8 is a cross sectional view of the water refilling device for water saving toilets in accordance with the present invention, which is provided with a refill pipe and an overflow pipe.

The first pipe 10, as shown in FIGS. 4, 5 and 8, is approximately a stepped cylinder with a big diameter upper portion 11 and a small diameter lower portion 12. The upper portion 11 defines a first chamber 13 therein, while the lower portion 12 defines an outlet 14 therein. A plurality of annularly arranged supporting ribs 15 extend upwards from the top end of the inner surface of the lower portion 12 and define a space 16. A fixing seat 17 is connected to the top ends of these supporting ribs 15 and provided with an inner thread 171. The outer surface of the fixing seat 17 is located a predetermined distance from the inner surface of the upper portion 11, which defines a water flow passage 172 between the outer surface of the fixing seat 17 and the inner surface of the upper portion 11. The top ends of any two neighboring supporting ribs 15 cooperate with the fixing seat 17 to define a water flow gap 151 which is in communication with the water flow passage 172 and the outlet 14. The outlet 14 can be inserted on the top end of the overflow 6 in such a manner that the top edge of the overflow pipe 6 is positioned against the bottom ends of the supporting ribs 15.

Figure 6:
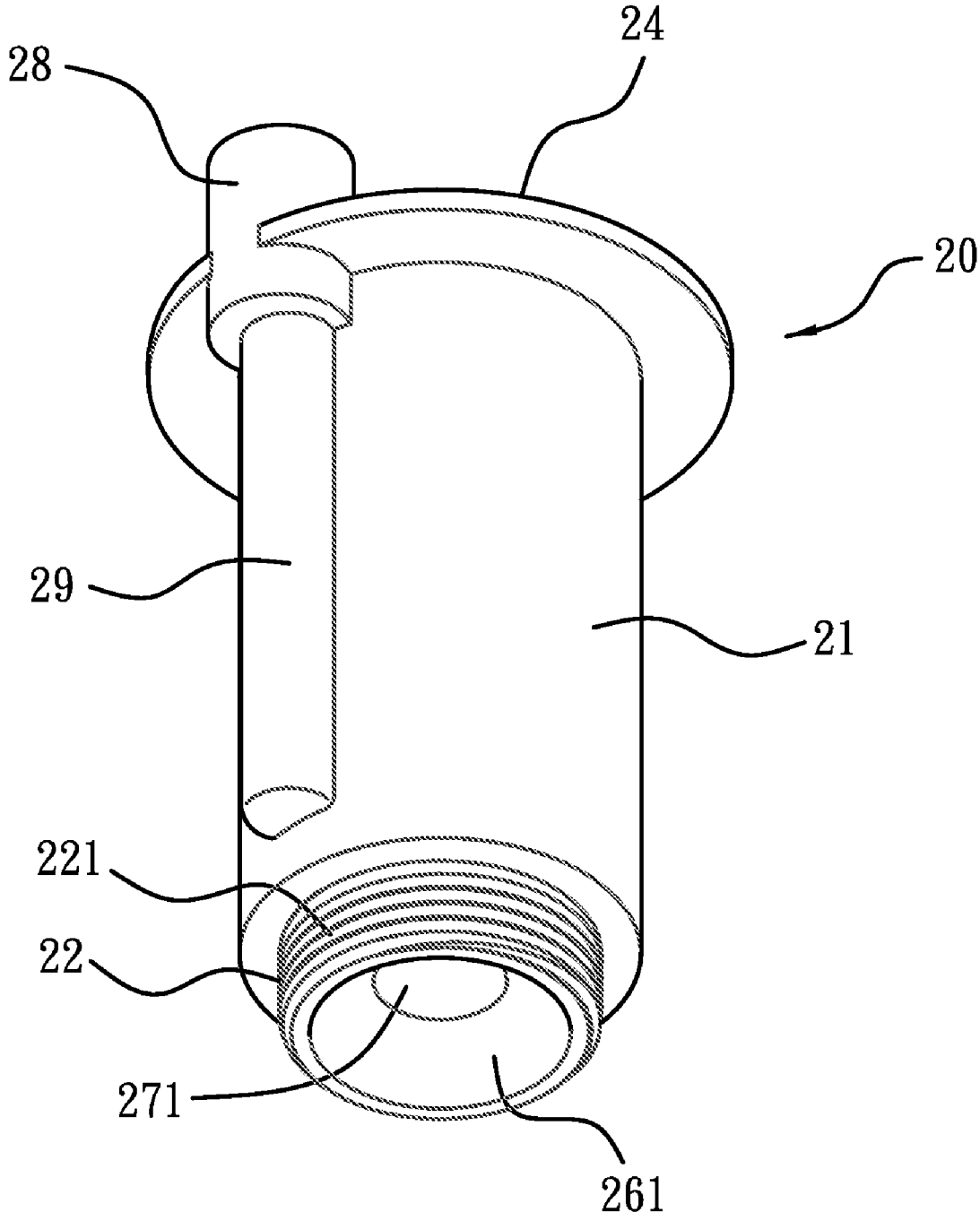
FIG. 6 is a perspective view of a second pipe of the water refilling device for water saving toilets in accordance with the present invention.
Figure 13:
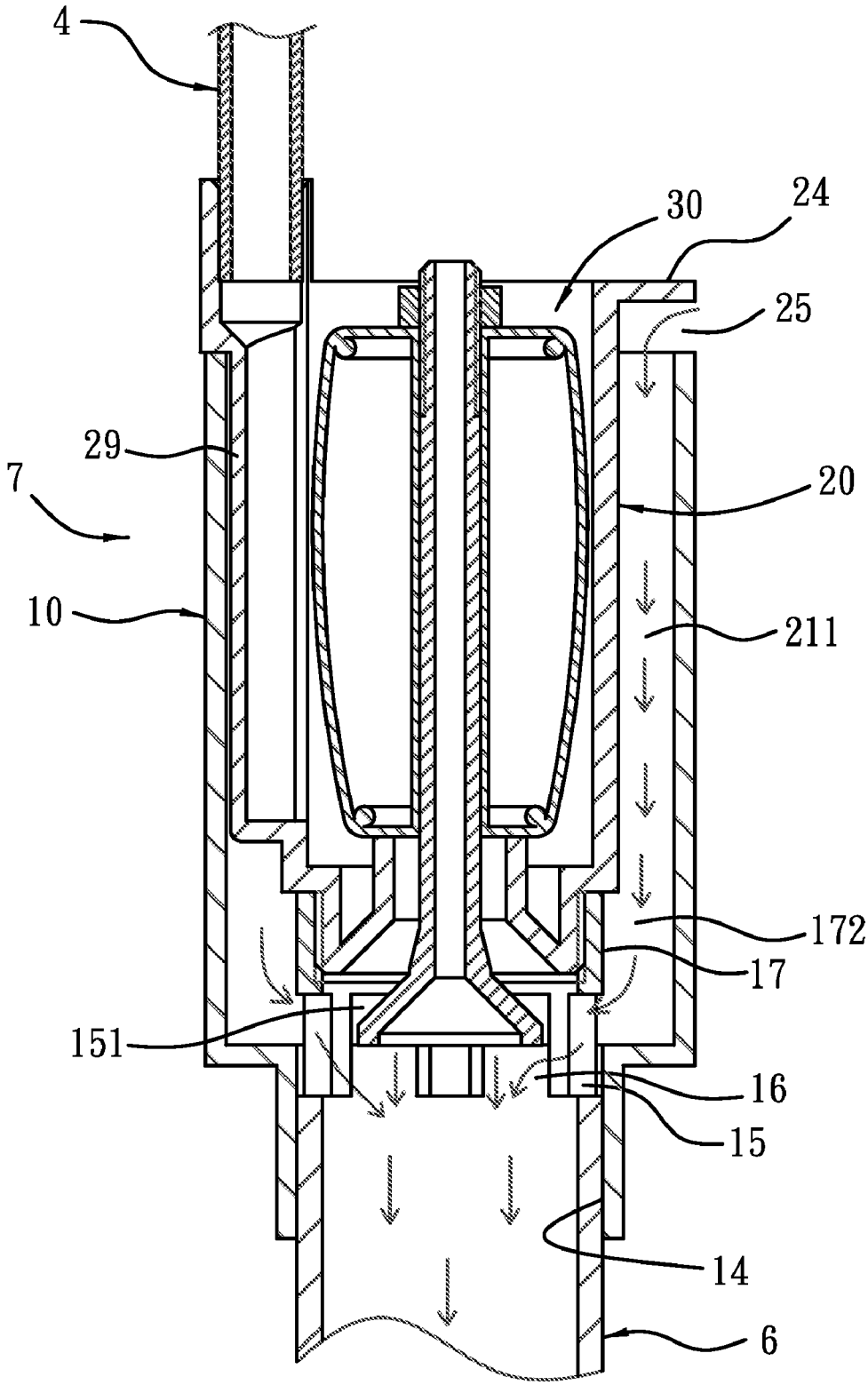
FIG. 13 shows that in case of a malfunction of the inlet valve, the water left in the water tank flows to the overflow pipe through the overflow inlet, the water flow passages and the water flow gaps.

The second pipe 20, as shown in FIG. 6, is approximately a stepped cylinder with a big diameter upper portion 21 and a small diameter lower portion 22. The upper portion 21 defines a second chamber 23, and the outer surface of the upper portion 21 and the inner surface of the first chamber 13 define a water flow passage 211 therebetween. The top end of the upper portion 21 extends outward to form an annular flange 24 whose outer diameter is equal to or more than the outer diameter of the upper portion 11 of the first pipe 10. The outer surface of the lower portion 22 is provided with an outer thread 221 to be screwed with the inner thread 171 of the fixing seat 17 of the first pipe 10. The annular flange 24 is located a certain distance from the top end of the first pipe 10 to define an overflow inlet 25 through which the water of the water tank 3 can flow to the water flow passages 211, 172 and the respective water flow gaps 151 and finally flow through the overflow pipe 6 and into the toilet bowl 2, as shown in FIG. 13, so that it can prevent water overflowing the water tank 3 in the case of malfunction of the inlet valve. The lower edge of the lower portion 22 tapers upwards to form a conical portion 26 with a conical surface 261, and then conical portion 26 extends axially upwards to form a pipe portion 27 which defines a through hole 271. The top end of the pipe portion 27 extends into the lower portion of the second chamber 23. The upper portion 21 is integrally connected with a pipe connector 28 which is located partially above and partially below the annular flange 24. The pipe connector 28 has an inserting hole 281 for insertion of the refill pipe 4, and an elongated pipe portion 29 axially extends downwards from the pipe connector 28 to the lower portion of the second chamber 23 and is defined with an inner guide passage 291 in communication with the inserting hole 281. The elongated pipe portion 29 is partially protruded out of the outer surface of the upper portion 21 and partially integral with the upper portion 21. The pipe connector 28 is defined with an axial slot 282 facing towards the central axis of the second pipe 20. The elongated pipe portion 29 is also defined with an axial slot 292 which is located at the connection between pipe portion 29 and the upper portion 21 and is connected to the axial slot 282.

Figure 7:
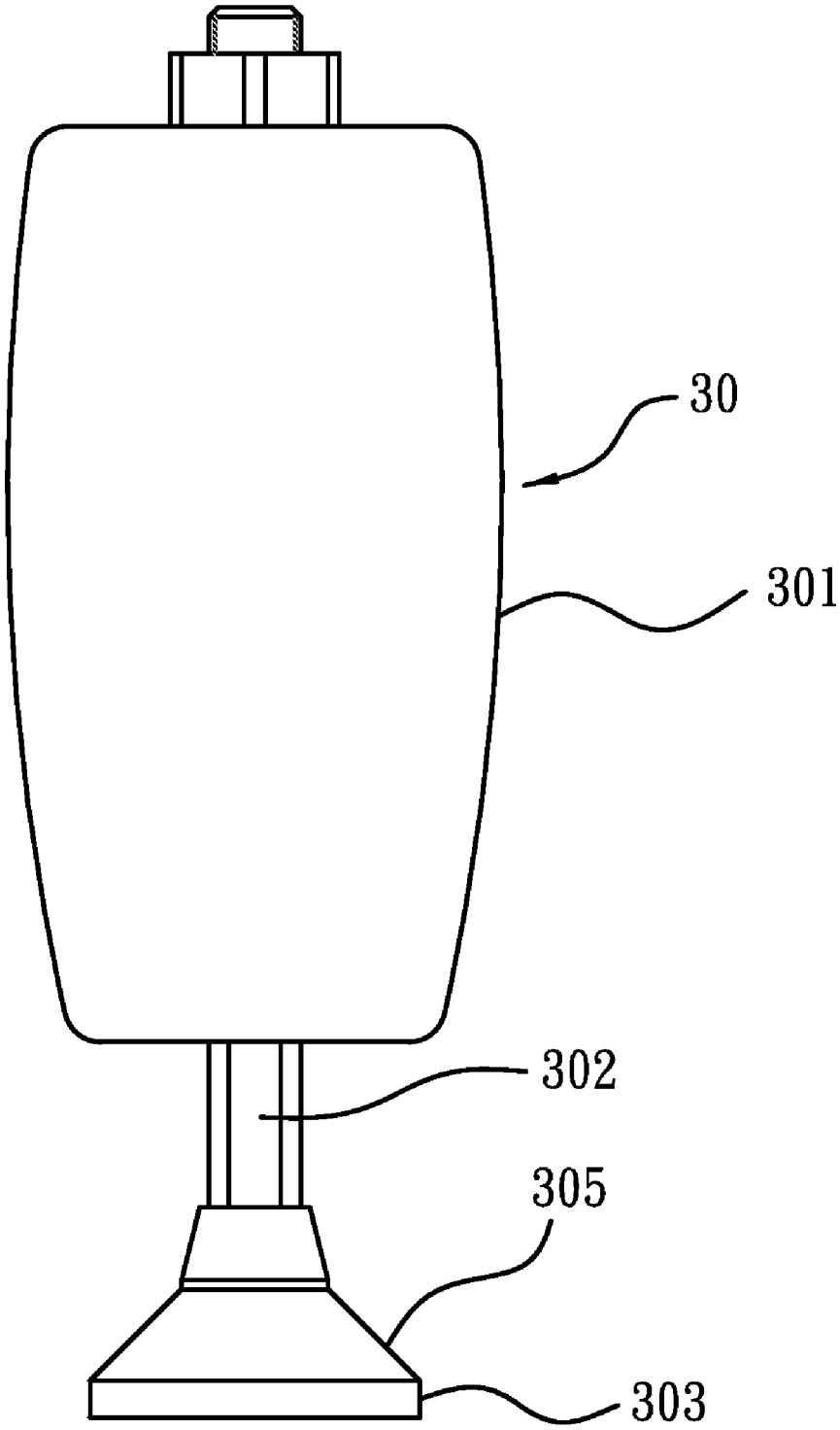
FIG. 7 is a side view of a float device of the water refilling device for water saving toilets in accordance with the present invention.
Figure 9:
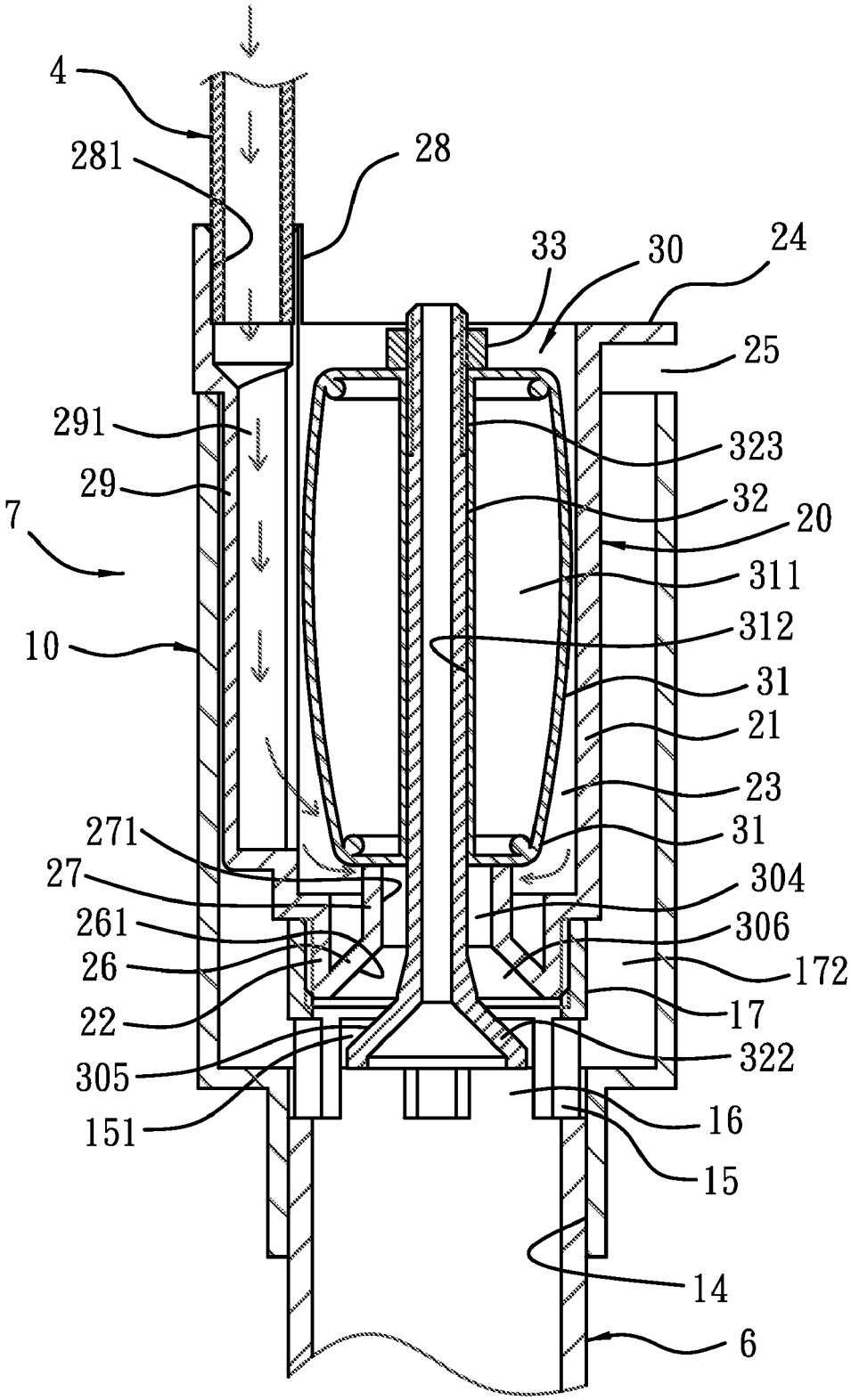
FIG. 9 shows the beginning of the water refilling process, wherein the float device doesn't move up.
Figure 10:
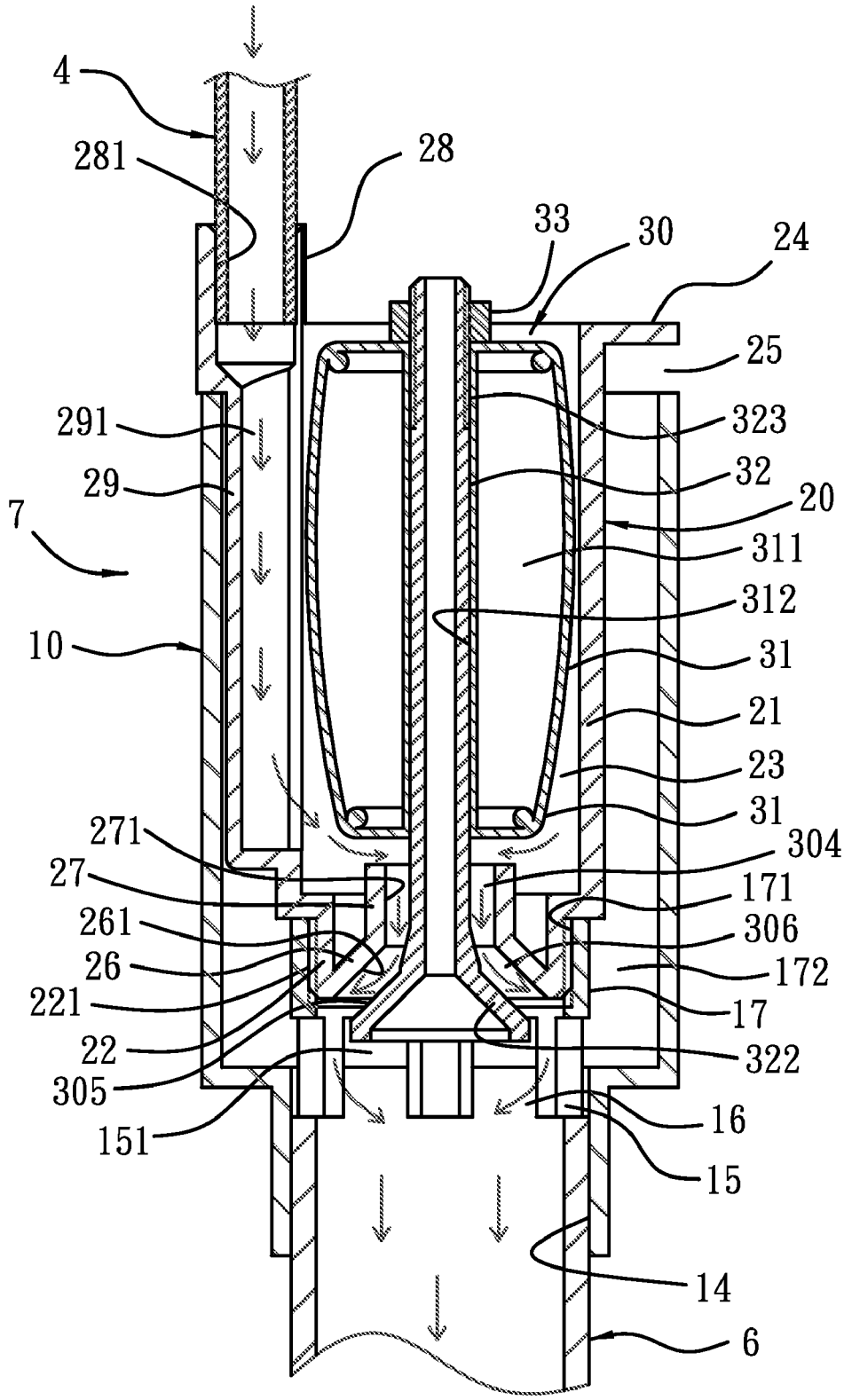
FIG. 10 shows that in the water refilling process, the float device is moving up, but the conical passage has not been closed.
Figure 11:
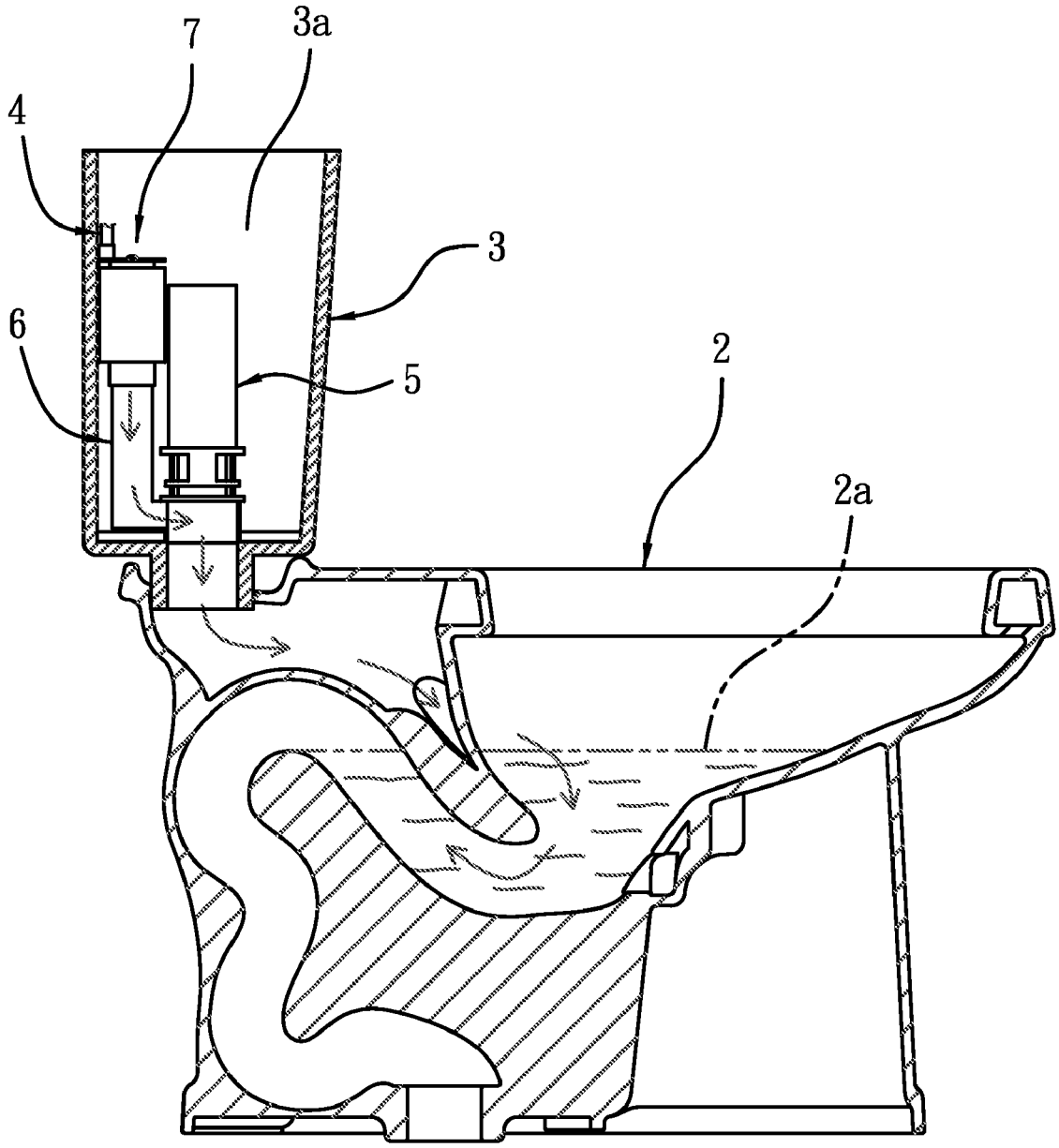
FIG. 11 shows that the water refilled from the refill pipe flows through overflow pipe and into the toilet bowl to form the water closing.
Figure 12:
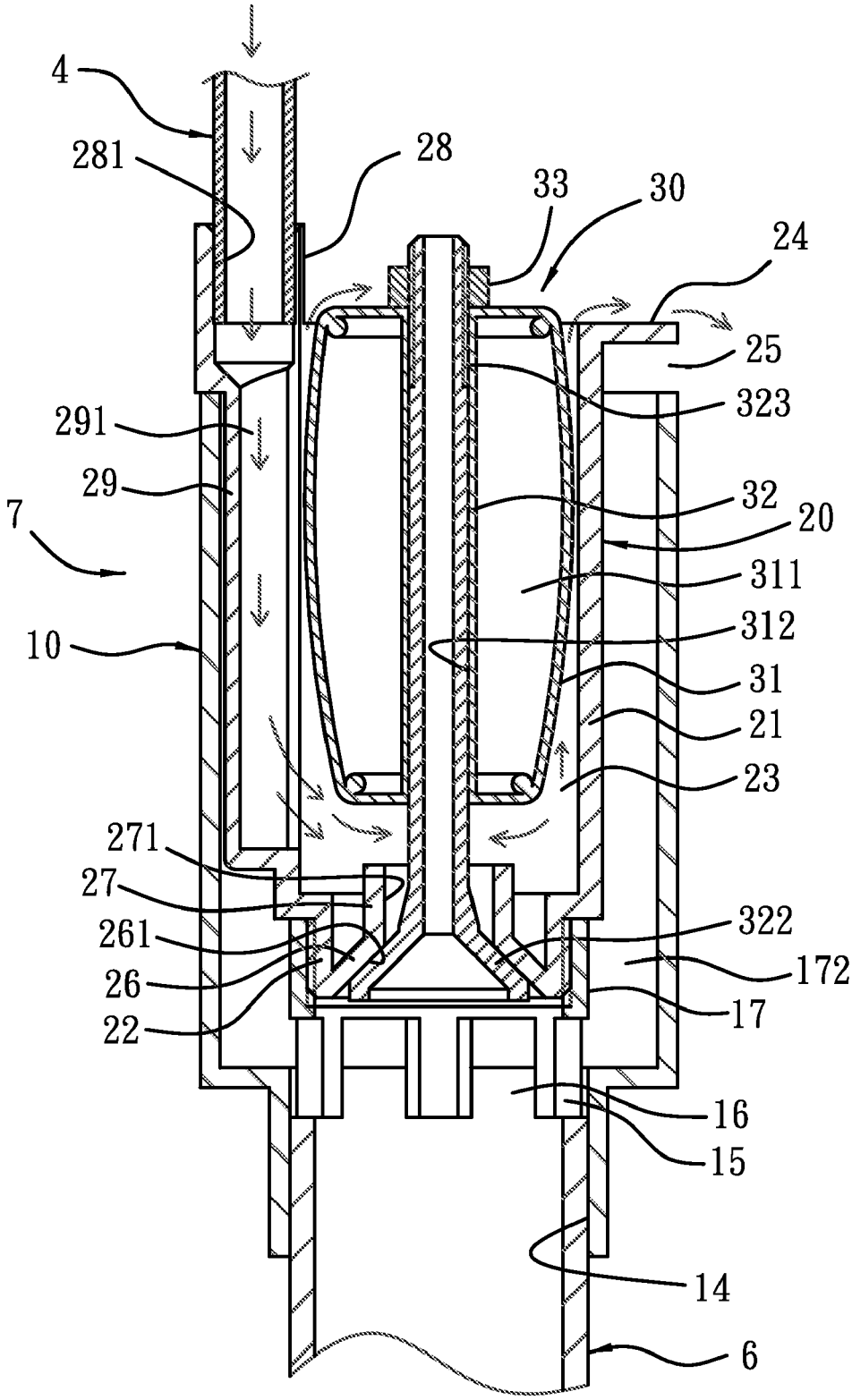
FIG. 12 shows that the refilled surplus water overflows the top end of the second chamber into the water tank after the formation of the water closing and the closing of the conical passage.

The float device 30, as shown in FIG. 7, comprises a float body 301, a rod portion 302 extending downwards from the bottom of the float body 301, and a sealing portion 303. The float body 301 is received in the second chamber 23 of the second pipe 20, and, in normal condition, the lower end of the float body 301 is pressed against the top end of the pipe portion 27, as shown in FIG. 8. The rod portion 302 inserts through the through hole 271 of the second pipe 20 in such a manner that the outer periphery of the rod portion 302 and the inner surface of the through hole 271 define a water flow passage 304 therebetween, and in normal condition, the water flow passage 304 is closed by the float body 301 pressing against the top end of the pipe portion 27. The sealing portion 303 is conical-shaped and has a conical surface 305, and in normal condition, the sealing portion 303 is kept in the space 16 under the effect of the gravity of the float device 30 and defines a conical passage 306 with respect to the conical surface 261 of the second pipe 20. With the conical passage 306, the outflow of water flowing therethrough can be controlled to be smaller than the inflow of water refilled into the second chamber 23 from the refill pipe 4, which enables the water to flow to the second chamber 23 and then to water flow passage 304 and the conical passage 306 and finally into the overflow pipe 6, as shown in FIGS. 9-11, to provide enough water to form the water closing 2*a*. After that, the float body 301 will move upward along with the rise of the water level of the second chamber 23 and drive the whole float device 30 to move upward, so that the conical surface 305 is controlled to press against the conical surface 261 within a predetermined time, as shown in FIG. 12, so as to close the conical passage 306, creating a quantitative water refilling effect, and the surplus water will overflow into the water tank 3 from the top end of the second chamber 23. When the conical passage 306 is closed, the water in the second chamber 23 can still be leaked into the overflow pipe 6 by a leakage design (not shown). In this embodiment, the leakage design is to form an incompletely sealed conical passage 306 when the conical surface 305 contacts the conical surface 261. The float device 30 of this embodiment further comprises a float ball 31, a fixing rod 32 and a nut 33, as shown in FIGS. 5, 6 and 8.

The float ball 31 forms the float body 301 and defines an annular chamber 311 therein and a non-circular central hole 312 inside thereof.

The fixing rod 32 includes a rod 321 and a conical washer 322 extending from the bottom of the rod 321. The rod 321 is inserted upwards through the through hole 271 of the second pipe 20 into the second chamber 23 and non-rotatably but movably inserted into the central hole 312 of the float ball 31. The top end of the rod 321 is provided with an outer thread 323, the conical washer 322 forms the sealing portion 303, and the exposed portion of the rod 321 between the conical washer 322 and the float ball 31 forms the rod portion 302.

The nut 33 is screwed with the outer thread 323 of the fixing rod 32 to restrict the axial position of the float ball 31 on the fixing rod 32 and can be rotated appropriately to adjust the distance between the float ball 31 and the conical washer 322, so that the opening and the outflow rate of the conical passage 306 can be adjusted accordingly.

The quantitative refill device 7 of the present invention can be assembled by inserting the outlet 14 of the first pipe 10 onto the top end of the overflow pipe 6 of the water tank 3, as shown in FIG. 8, and then connecting the other end of the first pipe 10 to the pipe connector 28 of the second pipe 20, and thus the quantitative refill device 7 is fixed.

In normal condition, no water is accumulated in the second chamber 23 of the quantitative refill device 7, or the water can be discharged through the conical passage 306. therefore, the float device 30 will automatically fall by gravity, making the bottom of the float ball 31 keep pressing against the top end of the pipe portion 27, as shown in FIG. 8, meanwhile, the conical surface 305 will disengage from the conical surface 261 to create the conical passage 306.

When the user presses the big flush button (not shown) of the flush valve 5, the big flush operation is carried out, meanwhile, the inlet valve is opened to refill the inner space 3*a* of the water tank and provide the water required for forming the water closing 2*a* of the toilet bowl 2. The water required for forming the water closing 2*a* flows from inlet valve to the refill pipe 4 and then flows from the refill pipe 4 to the pipe connector 28 of the refill device 7, as shown in FIG. 9, wherein most part of the water flows to the lower portion of the second chamber 23 of the second pipe 20 through the guide passage 291 and a small part of the water flows into the axial slots 282 and 292. Since the water flow passage 304 is closed by the bottom of the float ball 31 in normal condition, water can be accumulated in the second chamber 23 at the beginning of the water refilling operation, and the float ball 31 will move upward along with the rise of the water level and disengage from the top end of the pipe portion 27 to open the water flow passage 304, so that the water of the second chamber 23 can flow to the overflow pipe 6 through the water flow passage 304 and the conical passage 306, as shown in FIGS. 10 and 11 and finally into the toilet bowl 2 to form the water closing 2*a*. It is to be noted that the outflow rate of the conical passage 306 can be pre-adjusted by the nut 33 to be smaller than the inflow rate of the water flowing from the refill pipe 4 to the second chamber 23, so that the water level of the second chamber 23 can rise gradually to push the float device 30 together with the float ball 31 upwards gradually, accordingly the opening degree and the outflow rate of the conical passage 306 is reduced while the float ball 31 moves up in an accelerated manner until the conical surface 305 contacts the conical surface 261 to close the conical passage 306 and stop water from flowing to the water closing 2*a*. In this way, the time for refilling water to form the water closing 2*a* can be controlled within the predetermined time, as shown in FIG. 12, achieving the quantitative water refilling effect. During the course of water refilling, a tiny amount of water of the second chamber 23 is leaking constantly due to the leakage design, since the amount of the water leakage is very small, it can be neglected.

At this moment, even if the conical passage 306 is closed, however, since the water of the inner space 3*a* of the water tank 3 doesn't reach the level required by the big flush, the refill pipe 4 will keep refilling water, so that the surplus water flowing into the second chamber 23 will flow through the space around the float ball 31 and the top end of the annular flange 24 and overflow the first pipe 10 into the inner space 3*a* of the water tank 3, thus not only speeding up the uprising of the water level of the water tank 3, but also preventing the refilled surplus water from flowing into the waste pipe and causing loss of water.

When the water of the water tank 3 reaches the level corresponding to the big flush, the inlet valve will stop refilling water to the water tank 3 and the refill pipe 4, the water left in the second chamber 23 will leak to the overflow pipe 6 by the leakage design, causing a slight decrease of the water level of the second chamber 23. It is to be noted that when the water level decreases, the float device 30 will fall by gravity, making the conical surface 305 appropriately disengage from the conical surface 261 to partially open the conical passage 306, which speeds up the water flow from the second chamber 23 to the overflow 6 through the conical passage 306, and then cause quick decrease of water level and quick opening of the conical passage 306. Through such repeated and alternative actions, the float ball 31 of the float device 30 can return very quickly to its normal position where the bottom of the float ball 31 is pressed against the top end of the pipe portion 27, as shown in FIG. 8. While the float device 30 falls, the water left in the second chamber 23 will flow very quickly through the water flow passage 304 and the conical passage 306 into the toilet bowl 2, however, since the amount of the water is very small, it can be neglected.

The quantitative refill device 7 of the present invention has an overflow passage design, when the inlet valve loses its sealing function and water is refilled nonstopply until the water level of the inner space 3*a* of the water tank 3 rise to the height of the overflow inlet 25 formed between the top end of the first pipe 10 and the annular flange 24 of the second pipe 20, the water can flow to the overflow pipe 6 through the water flow passages 211 and 172 and the water flow gaps 151, as shown in FIG. 13, so that the water of the water tank 3 can be prevented from overflowing the water tank 3.

Figure 14:
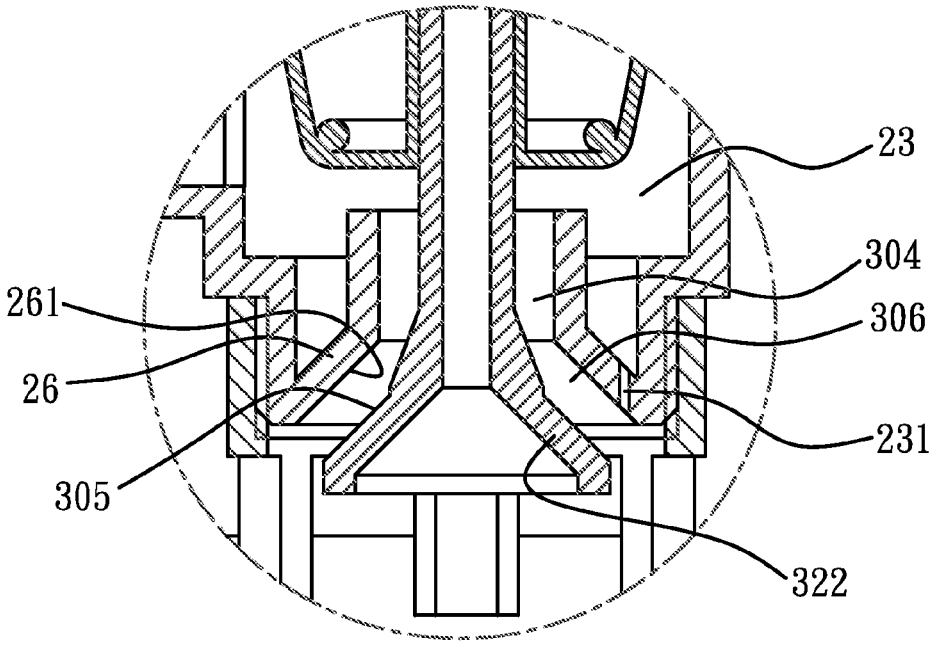
FIG. 14 is an enlarged cross sectional view of the present invention, showing a micro passage formed at the bottom of the second chamber.
Figure 15:
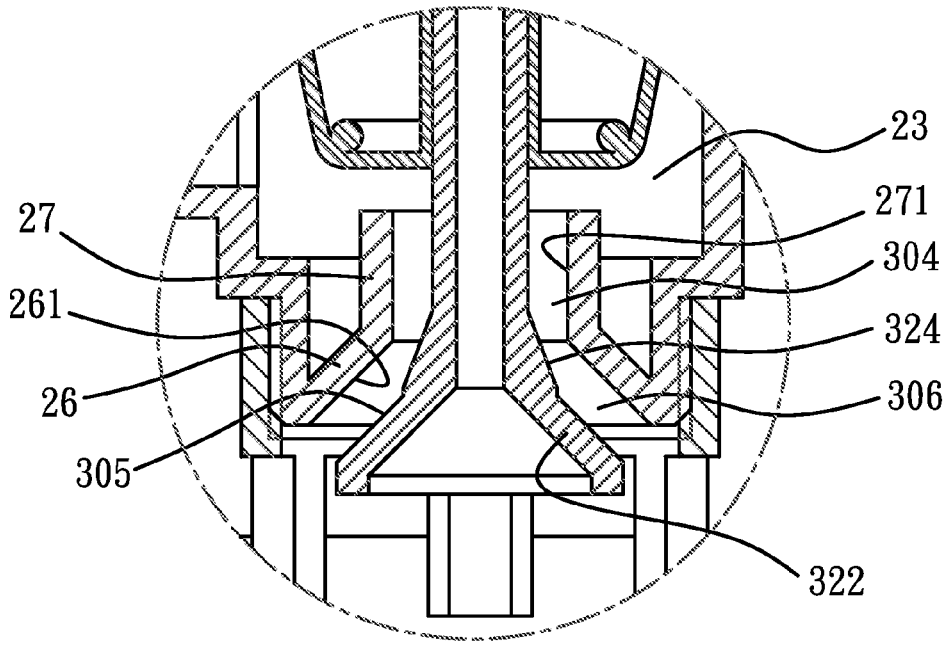
FIG. 15 is an enlarged cross sectional view of the present invention, showing a conical portion which tapers upwards from the bottom of the rod.

The leakage design of the present invention has many alternatives, for example, in the first embodiment, the leakage design can be achieved by the incompletely sealed conical passage 306 which is formed when the conical surface 305 presses against the conical surface 261. For example, at least one of the conical surfaces 305 and 261 has an uneven and rough contact surface, or forming at least one micro passage (not shown) when the conical surface 305 presses against the conical surface 261, or the conical surfaces 305 and 261 are made of an appropriate material which makes it less likely for the conical surfaces 305 and 261 to contact in a sealing manner. In a second embodiment of the leakage design, a predetermined surface of the bottom of the second chamber 23 is defined at least one micro passage 231 in communication with the overflow pipe 6, as shown in FIG. 14. The micro passage 231 penetrates the conical portion 26 to the conical surface 261 and located in a position which is not covered by the conical surface 305. In principle, the abovementioned leakage designs can enable the water left in the second chamber 23 to leak to the overflow pipe 6 when the conical passage 306 is closed, namely, it enables the conical passage 306 to be closed automatically and makes the float device 30 return to its original position when the refill pipe 4 stop refilling water.

The outflow rate of the water of the second chamber 23 flowing to the overflow pipe 6 through the conical passage 306 can be controlled by using the nut 33 to adjust the opening degree between the conical surfaces 305 and 261. Alternatively, it can form a conical portion 324 which tapers upwards from the bottom of the rod 321 and is located adjacent the conical washer 322, so that the outflow rate of the water of the second chamber 23 flowing to the overflow pipe 6 through the conical passage 306 can also be controlled by using the nut 33 to change the cross section area of the water flow passage 304 defined between the conical portion 324 and the inner surface of the through hole 271.

Besides the nut 33, the restriction structure between the float ball 31 and the rod 321 of the float device 30 can also take other forms. For example, it can be a locking device which is axially movable along the rod 321, or a locking member which enables the float ball 31 to be locked and moved along the rod 321.

The quantitative refill device 7 of the present invention can cooperate with the double function flush valve 5, but it is limited to this, along as the flush valve 5 has small and big flush buttons and is connected with an overflow pipe 6, it can cooperate with the quantitative refill device 7.

While we have shown and described various embodiments in accordance with the present invention, it is clear to those skilled in the art that further embodiments may be made without departing from the scope of the present invention.

What is claimed is:

1. A quantitative refill for a water saving toilet being disposed in a water tank, inside the water tank being disposed an inlet valve, a double function flush valve, an overflow pipe connected to the flush valve, and a refill pipe connected to the inlet valve, the quantitative refill device comprising:

a first pipe with a lower end fixed to a top end of the overflow pipe defining a first chamber and an outlet which is in communication with a lower end of the first chamber and the overflow pipe;

a second pipe fixed in the first chamber of the first pipe, an outer surface of the second pipe and an inner surface of the first chamber defining a water flow passage therebetween, a top end of the water flow passage defining an overflow inlet for allowing water in the water tank to overflow, a lower end of the water flow passage being connected to the outlet of the first pipe, the second pipe being defined a second chamber therein, and in the second chamber the water is refilled from the refill pipe, a lower edge of the second pipe tapering upwards to form a conical surface, and then the conical surface extending upwards to form a through hole in communication with the second chamber;

a float device comprising a float body, a rod portion extending downwards from a bottom of the float body, and a sealing portion extending downwards from a bottom of the rod portion, the float body being received in the second chamber of the second pipe, the rod portion being inserted through the through hole of the second pipe in such a manner that an outer periphery of the rod portion and an inner surface of the through hole define a water flow passage therebetween, the sealing portion being defined with a conical surface shaped correspondingly to the conical surface of the second pipe, and in normal condition, the sealing portion, under the effect of the gravity of the float device, defines a conical passage with respect to the conical surface of the second pipe, the conical passage enables an outflow of water flowing therethrough to be controlled to be smaller than an inflow of water refilled into the second chamber from the refill pipe, at the beginning of a water refilling process, water flows to the second chamber and then to the water flow passage and the conical passage and finally into the overflow pipe, to provide enough water to form a water closing, after that, the float body will move upward along with a rise of a water level of the second chamber and drive the whole float device to move upward, making the conical surface press against the conical surface, so as to close the conical passage after the water has been refilled for a predetermined time, creating a quantitative water refilling effect, and surplus water will overflow into the water tank from a top end of the second chamber, when the conical passage is closed, the water in the second chamber can still be leaked into the overflow pipe by a leakage design.

2. The quantitative refill for a water saving toilet as claimed in claim 1, wherein the first pipe is a stepped cylinder with a big diameter upper portion and a small diameter lower portion, the upper portion defines the first chamber therein, while the lower portion defines the outlet which is to be inserted on the top end of the overflow therein.

3. The quantitative refill for a water saving toilet as claimed in claim 2, wherein a plurality of annularly arranged supporting ribs extend upwards from a top end of an inner surface of the lower portion of the first pipe and define a space for receiving the sealing portion of the float device, lower ends of the supporting ribs are positioned against the top end of the overflow pipe, a fixing seat is connected to the top ends of these supporting ribs and provided with an inner thread, an outer surface of the fixing seat is located a predetermined distance from the inner surface of the upper portion to define a water flow passage, the top ends of any two neighboring supporting ribs cooperate with the fixing seat to define a water flow gap which is in communication with the water flow passage and the outlet, the lower portion of the second pipe is provided with an outer thread to be screwed with the inner thread of the fixing seat.

4. The quantitative refill for a water saving toilet as claimed in claim 1, wherein the top end of the second pipe extends outward to form an annular flange through which the water overflowing the top end of the second chamber can flow into the water tank through the first pipe, the annular flange is located a certain distance from the top end of the first pipe to define the overflow inlet.

5. The quantitative refill for a water saving toilet as claimed in claim 3, wherein the second pipe is approximately a stepped cylinder with a big diameter upper portion and a small diameter lower portion, the upper portion defines the second chamber, and an outer surface of the upper portion and an inner surface of the first chamber define the water flow passage therebetween, an outer surface of the lower portion is provided with an outer thread to be screwed with the inner thread of the fixing seat of the first pipe, a lower edge of the lower portion tapers upwards to form a conical portion which is formed with the conical surface, and then conical portion extends axially upwards to form a pipe portion which defines a through hole, a top end of the pipe portion extends into the lower portion of the second chamber for allowing a lower end of the float body to be pressed and positioned against the top end of the pipe portion.

6. The quantitative refill for a water saving toilet as claimed in claim 5, wherein the top end of the upper portion of the second pipe extends outward to form an annular flange which is located a certain distance from the top end of the upper portion of the first pipe to define an overflow inlet, The upper portion is integrally connected with a pipe connector which is located partially above and partially below the annular flange, the pipe connector has an inserting hole for insertion of the refill pipe, and an elongated pipe portion axially extends downwards from the pipe connector to a lower portion of the second chamber and is defined with an inner guide passage in communication with the inserting hole, the elongated pipe portion is partially protruded out of an outer surface of the upper portion of the second pipe and partially integral with the upper portion of the second pipe, the pipe connector is defined with an axial slot, and the elongated pipe portion is also defined with an axial slot.

7. The quantitative refill for a water saving toilet as claimed in claim 1, wherein an outflow rate of the water of the second chamber flowing to the overflow pipe through the conical passage is changeable by adjusting a distance between the float body and the sealing portion.

8. The quantitative refill for a water saving toilet as claimed in claim 7, wherein the distance between the float body and the sealing portion can be changed by adjusting an axial position of the float body on the rod portion.

9. The quantitative refill for a water saving toilet as claimed in claim 8, wherein the float device comprises a float ball, a fixing rod and a nut, the float ball forms the float body and defines an annular chamber and a central hole inside thereof, the fixing rod includes a rod and a conical washer extending from the bottom of the rod, the rod is inserted upwards through the through hole of the second pipe into the second chamber and non-rotatably but movably inserted into the central hole of the float ball, the top end of the rod is provided with an outer thread, the conical washer forms the sealing portion, and an exposed portion of the rod between the conical washer and the float ball forms the rod portion, the nut is screwed with the outer thread of the fixing rod to restrict the axial position of the float ball on the fixing rod and can be rotated appropriately to adjust a distance between the float ball and the conical washer.

10. The quantitative refill for a water saving toilet as claimed in claim 7, wherein a bottom of the rod tapers upwards to form a conical portion, a cross section area of the water flow passage defined between the conical portion and the inner surface of the through hole is adjustable by adjusting the distance between the float body and the sealing portion.

11. The quantitative refill for a water saving toilet as claimed in claim 1, wherein the leakage design is achieved by forming the incompletely sealed conical passage when the conical surface presses against the conical surface.

12. The quantitative refill for a water saving toilet as claimed in claim 11, wherein the leakage design is such that at least one of the conical surfaces and has an uneven and rough contact surface.

13. The quantitative refill for a water saving toilet as claimed in claim 1, wherein the leakage design is such that a predetermined surface of the bottom of the second chamber is defined at least one micro passage in communication with the overflow pipe.

14. The quantitative refill for a water saving toilet as claimed in claim 13, wherein the micro passage penetrates the conical portion to the conical surface and located in a position which is not covered by the conical surface.

* * * * *